United States Patent [19]

Abrams et al.

[11] Patent Number: 4,461,227

[45] Date of Patent: Jul. 24, 1984

[54] QUICK RELEASE MECHANISM FOR AN AUTOMATIC SEWING MACHINE WORKHOLDER

[75] Inventor: Jack S. Abrams, Northbrook; Robert L. Kasrow, Hoffman Estate, both of Ill.

[73] Assignee: Union Special Corporation, Chicago, Ill.

[21] Appl. No.: 303,689

[22] Filed: Sep. 18, 1981

[51] Int. Cl.[3] ..... D05B 21/00

[52] U.S. Cl. ..... 112/121.15; 112/65

[58] Field of Search ..... 112/121.11, 121.12, 112/121.15, 65, 67, 114, 2, 240

[56] References Cited

U.S. PATENT DOCUMENTS

| | | | |
|---|---|---|---|
| 2,932,267 | 4/1960 | Nickerson . | |
| 2,944,496 | 7/1960 | Gardner | 112/65 |
| 2,985,127 | 5/1961 | Reebere et al. . | |
| 2,995,098 | 8/1961 | Nickerson . | |
| 3,082,721 | 3/1963 | Bono . | |
| 3,143,094 | 8/1964 | Yamada . | |
| 3,164,112 | 1/1965 | Bono . | |
| 3,323,476 | 6/1967 | Kass | 112/65 |
| 3,326,160 | 6/1967 | Marino . | |
| 3,349,732 | 10/1967 | Perrella et al. | 112/65 |
| 3,349,741 | 10/1967 | Bono . | |
| 3,401,656 | 9/1968 | Becker et al. . | |
| 3,814,038 | 6/1974 | Dorosz et al. | 112/121.15 |
| 3,988,993 | 11/1976 | Brophy . | |
| 4,165,699 | 8/1979 | Nishi . | |
| 4,171,672 | 10/1979 | Dorosz et al. . | |
| 4,212,256 | 7/1980 | Jimenez . | |
| 4,213,411 | 7/1980 | Knowles . | |
| 4,286,531 | 9/1981 | Molloy . | |

FOREIGN PATENT DOCUMENTS

| | | |
|---|---|---|
| 1485205 | 8/1969 | Fed. Rep. of Germany . |
| 2506292 | 9/1975 | Fed. Rep. of Germany . |
| 7823991 | 1/1979 | Fed. Rep. of Germany . |

*Primary Examiner*—Henry Jaudon

*Attorney, Agent, or Firm*—John A. Schaerli; John W. Harbst

[57] ABSTRACT

A mechanism for releasably securing a workholder to the automatically controlled carriage of a sewing machine during the sewing machine cycle. The mechanism includes a pair of coacting connector means operative to fixedly couple the workholder and the automatically controlled carriage together along with mechanism for automatically uncoupling the coacting connectors and propelling the workholder from the carriage at the completion of the sewing operation.

15 Claims, 5 Drawing Figures

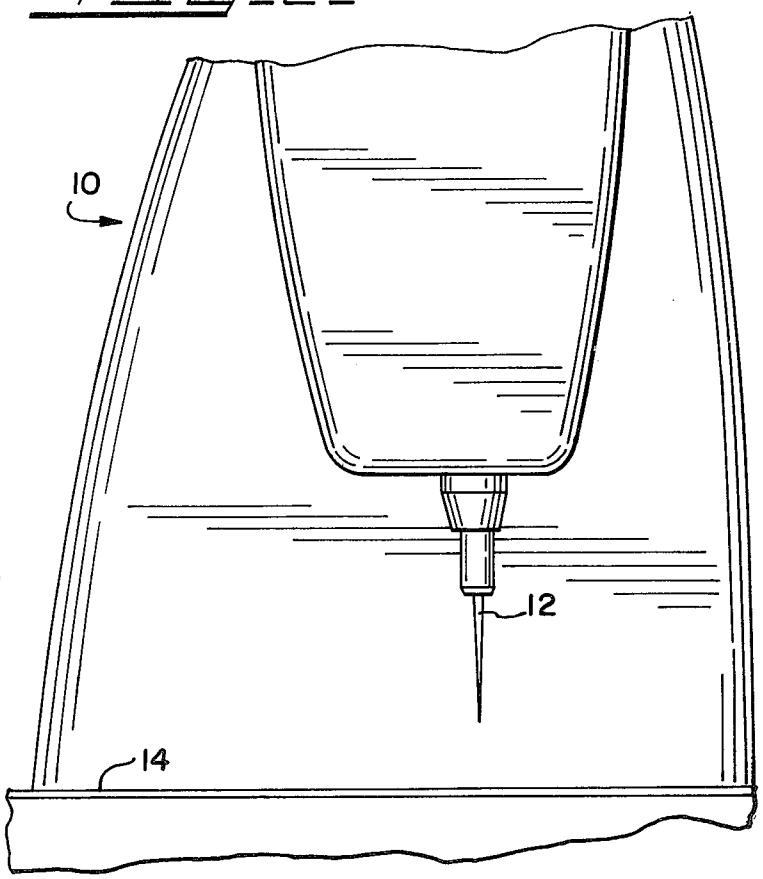
FIG-2-
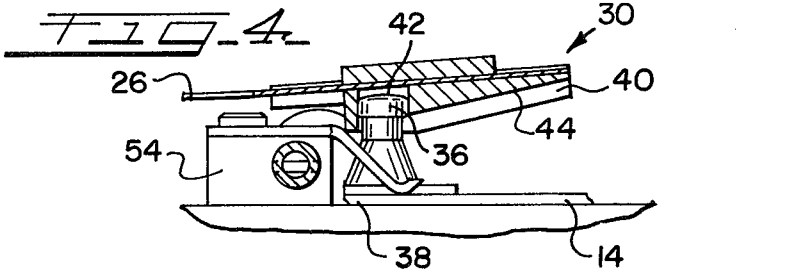
FIG-4-
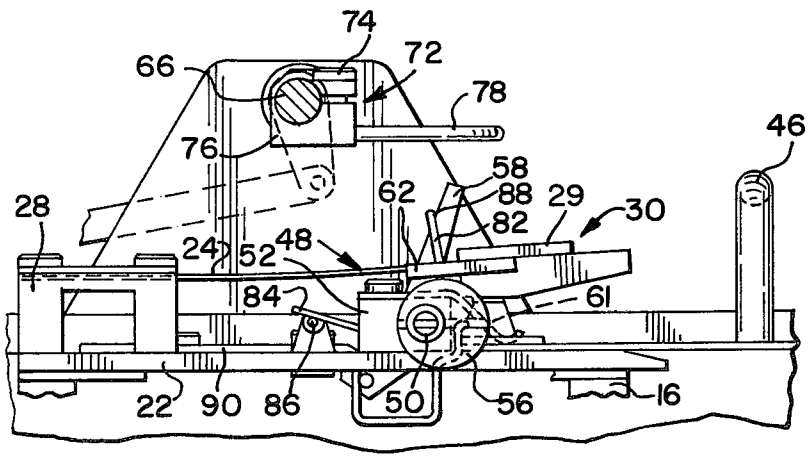

QUICK RELEASE MECHANISM FOR AN AUTOMATIC SEWING MACHINE WORKHOLDER

FIELD OF THE INVENTION

This invention relates to sewing machines, and in particular to automatic sewing machines having interchangeable workholders.

BACKGROUND OF THE INVENTION

The ever increasing cost of labor has provided great incentive for expanding the use of automation. Accordingly, in recent years, many sewing machine manufacturers have and are continuing to develop sewing machines which automatically move a workpiece beneath the sewing instrumentalities of the machine. In such machines, automatically controlled carriages or carriers, having the workholders secured thereto, respond to digitly controlled means and are effective to move the work beneath the sewing instrumentalities in a programmed mode of operation. Thus, the operator of such a machine is no longer required to guide the workpiece under the sewing instrumentalities. The operator need only position a workpiece in the workholder, secure the workholder to the carriage, remove the workholder at the completion of the sewing operation, and replace the workholder with another. While the machine is operating, the operator is free to remove the sewn workpiece from the released workholder and replace it with another to be sewn so that the workholder is ready for positioning on the carriage for yet another operation.

Even though such automatic machines have reduced the time spent in producing an acceptable workpiece, the operator handling time between operations remains a problem. Between sewing operations, the time spent in replacing one workholder with another must be kept at a minimum for automatic machines to be a profitable investment. Thus, a quick release mechanism which assures accurate positioning of the workholder with respect to the automatically controlled carriage is required. Fastening means, such as bolts or screws will not suffice for it takes too long to effectuate such means. U.S. Pat. No. 3,988,993 issued Nov. 2, 1976 to Robert V. Brophy discloses a workholder that is fitted over pins carried by the automatic carriage. Such an arrangement, however, also suffers drawbacks. It has been found, with a pin type arrangement that the holes in the workholder must align perfectly with the pins on the automatically controlled carriage before the workholder can be dropped over the pins. The operator cannot afford the time required to be assured that perfect alignment between the apertures and pins is provided. Also, the tolerances between the pins and holes needs to be extremely close to prevent chattering of the workholder. Even if such close tolerances could be obtained, at times, a wedging action results whereby requiring the workholder to be forceably removed from the carriage. Thus, the time gained by the automatic operation of the machine, is offset by the time spent in removing the workholder from the automatically controlled carriage. Thus, the need for a quick release mechanism adapted to releasably affix a workholder to a automatically controlled carriage of a sewing machine remains unanswered.

SUMMARY OF THE INVENTION

In view of the above, and accordance with the present invention, there is provided a quick release mechanism that is effective to releasably secure a workholder to the automatic carriage of a sewing machine. The problem of overcoming the drawbacks associated with other mechanisms is essentially solved by providing the workholder and carriage assembly with mutually engagable connector means that are readily releasable but which secure the workholder to the carriage during the sewing operation. The connector means comprise a spring biased positive position and retaining means having a tapered socket adapted to slidably receive a spherically shaped element. The tapered socket aided by the resiliency of spring means act to releasably wedge the spherically shaped element in position thereby locating and locking the workholder with respect to the carrier. Means are also provided for automatically releasing the connector means and for propelling or ejecting the workholder from the carrier thus easing the insertion of the next workholder into its operative position.

In view of the above, it is a primary object of this invention to provide a quick release mechanism for releasably securing a workholder to the automatically controlled carriage of a sewing machine.

Another object of this invention is the provision of coacting connector means which allow a workholder to be releasably secured to movable carriage means of an automatic sewing machine by means of a sliding action.

Another object of this invention is the provision of a releasable securing mechanism for affixing a workholder to the automatically controlled carriage of a sewing machine and which includes means for automatically releasing the workholder from the carriage at the completion of the sewing operation.

Still another object of the present invention is the provision of a releasable securing mechanism for affixing a workholder to the automatically controlled carriage of a sewing machine and which includes means for releasing the workholder from the carriage and for propelling the workholder from the carriage at the completion of the sewing operation.

Yet another object of the present invention is the provision of a quick release mechanism for the workholder of an automatic sewing machine which is economical to manufacture and efficient in operation.

Further objects and advantages of this invention will become apparent from the description now to follow of the preferred embodiment thereof shown by way of example in the accompanying drawings in which:

FIG. 2 is a sectional view taken along line 2—2 of FIG. 1;

FIG. 4 is a sectional view taken along line 4—4 of FIG. 1;

DETAILED DESCRIPTION OF THE PREFERRED EMBODIMENT

Figure 1:
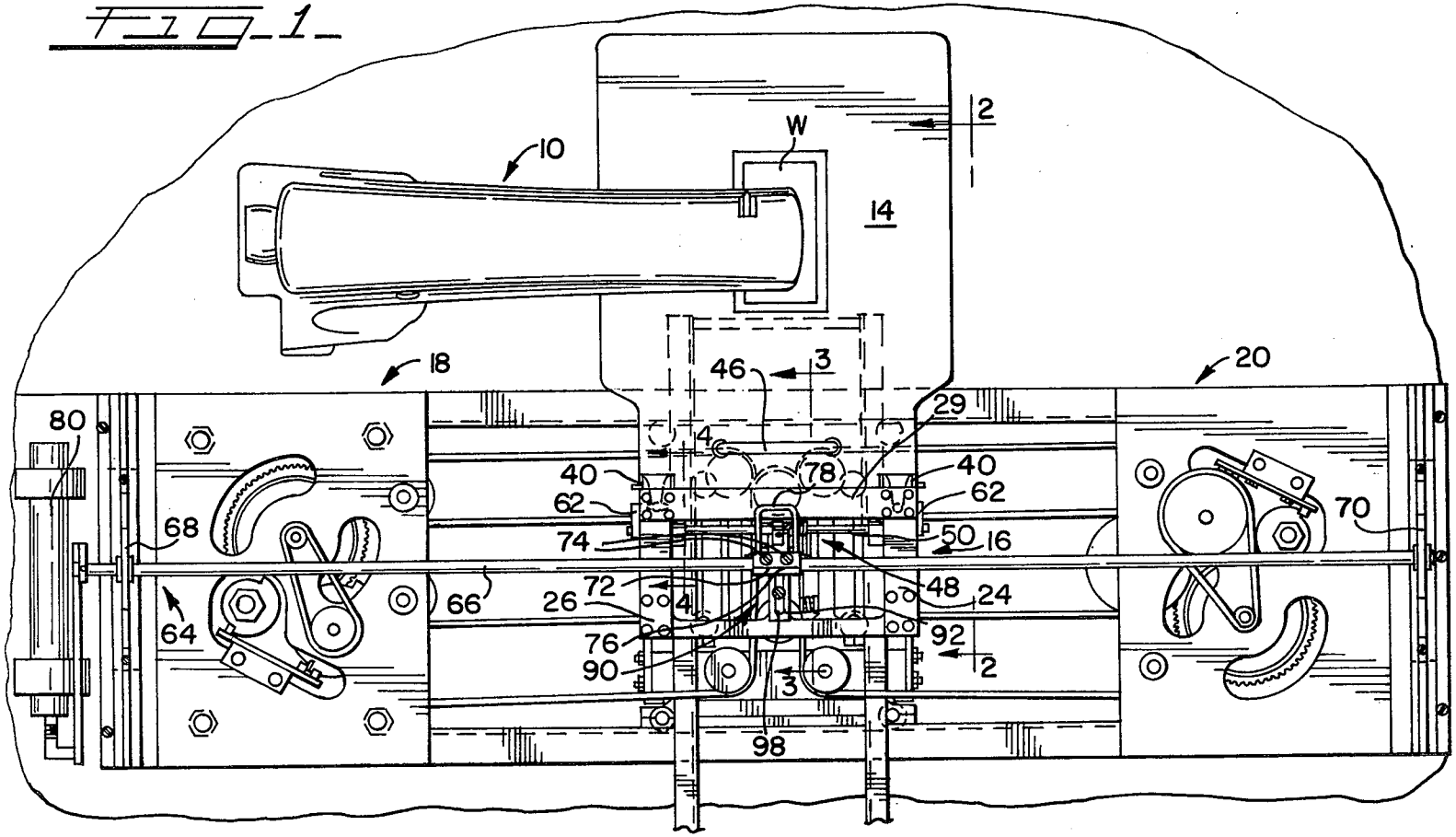
FIG. 1 is a top plan view of a portion of an automatic sewing machine.

Referring now to the drawings, wherein like reference numerals indicate like parts throughout the several views, there is shown a programmed controlled sewing machine 10 having stitch forming devices including an endwise reciprocal needle means 12 (FIG. 2). As shown in FIG. 1, a pallet or workholder 14 is provided for retaining one or more workpieces W that are to be sewn. The workholder is moved in a horizontal plane relative to the sewing machine needle by an automatically controlled carriage or carrier means 16. X and Y coordinate movements are imparted to the carriage by a pair of drive units 18 and 20. As seen in FIG. 1, the Y coordinate direction being aligned with the longitudinal axis of the machine and the X coordinate direction being transverse to the longitudinal axis of the machine.

Turning to FIG. 2 there is shown an apparatus for rigidly securing the workholder to the automatically controlled carriage or carrier means. The uniqueness of the present invention includes its ability to permit quick and ready release and resecurement of a workholder whereby allowing the operator to readily interchange workholders. To illustrate one embodiment of the invention, there is shown a supporting plate 22 which is adapted for securement to the automatically controlled carriage of the machine. A pair of flexible arms or leaf springs 24 and 26 are secured, in a cantilevered fashion, to the support plate by a mounting bracket 28. A bridge 29 secures the free ends of the leaf springs together whereby adding rigidity to the mechanism by preventing lateral deflection of the leaf springs. As disclosed below, the resilient action of the leaf springs serve to increase the holding power of a workholder clamping device 30. The clamping device includes a pair of clearance free matable connector means arranged on the workholder and carrier which are adapted to affix or lock the workholder to the automatically controlled carriage such that the movement of the workholder will be controlled by the movement of the automatically controlled carrier.

Figure 3:
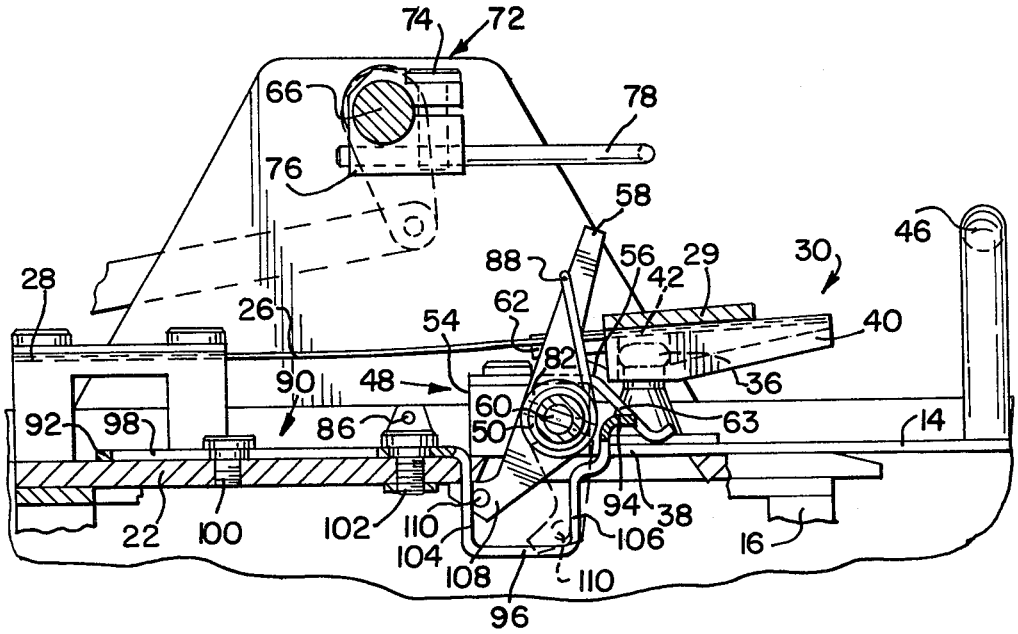
FIG. 3 is a sectional view taken along line 3—3 of FIG. 1.
Figure 5:
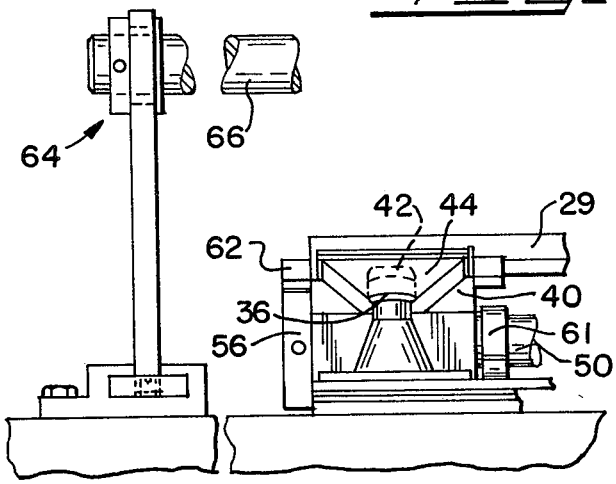
FIG. 5 is a front elevational view of a portion of the present invention.

In the present invention, and as may best been seen in FIGS. 3 and 4, the mutually engagable elements of the workholder clamping device include a spherically shaped lug or insert means 36 that is adapted for cooperation with a positive position and retaining means 40 having a socket 42 and carried on the free end of each flexible arm. In the preferred form, the spherically shaped lug or ball stud means 36 is supported on the marginal edge portion 38 of the workholder 14 and is adapted for slidable insertion into the socket 42. Preferably, the socket 42 is tapered such that a releasable wedging or clearance free engagement, enhanced by the spring action of the flexible arms, is maintained with respect to the spherically shaped lug 36. Also, as shown in FIG. 1, the socket means, provided in one of said position and retaining means, may be elongated along a line of common centers between the sockets. As is appreciated, such socket elongation does not deter from the clamping effect of the cooperable elements but does provide for tolerance differences. As additionally seen in FIG. 5, the position and retaining means 40 may be provided, along its underside, with a camming surface 44 which extends away from the socket 42 in a generally V shaped form. By this construction, the ball stud or lug means 36 is positively guided to the socket 42 and the operator need exert only a slight sliding pressure on the handle 46 (FIG. 3) of the workholder whereby securing same with respect to the automatically controlled carrier. As illustrated, the lug or ball stud means 36 may be crowned to lessen the spring deflection and thereby lessen the amount of force required to lock the workholder with respect to the carriage without lessening the locking effect therebetween.

Turning to FIGS. 1, 2 and 3, a release mechanism 48 is provided to uncouple the workholder clamping device 30 at the completion of the sewing operation. For purposes of this description, suffice it to say that a sewing operation is defined by that length of time the machine is sewing on any given operation. In the preferred form, the release mechanism includes a revoluble shaft 50 carried by support means 52 and 54 with a camming member or eccentric 56 arranged at each end of the shaft. Intermediate the eccentrics 56 is a latch member or lever means 58 that is pin connected, as at 60 (FIG. 3), to the shaft 50. Actuation of the latch member results in rotation of the shaft 50 whereby causing the eccentrics 56 to engage an extension or ear 62 provided on each position and retaining means 40. Ultimately, the eccentrics are effective to disconnect the coupling members by sufficiently raising the position and retaining means 40 such that the spherical lug 36 is removed from the socket 42. The present invention further provides means for positively releasing the ball stud 36 from the socket 42. The positive release means includes spring like fingers 61 and 63 that may be carried by the support means 52 and 54. The fingers are operative to retain the marginal edge 38 of the workholder in place when the position and retaining means are raised whereby assuring removal of the lug means from its respective socket. Having once released or disconnected the mutually engagable coupling elements, the latch is returned to the position shown in FIGS. 2 and 3 whereby lowering the position and retaining means into a position to accept another workholder.

Turning to FIG. 1, in the presently preferred form, an adjustable bail mechanism, generally identified by numeral 64, is effective to automatically actuate the release mechanism at the completion of the sewing operation. The bail mechanism includes a revolubly mounted shaft 66 whose ends are supported in adjustably mounted upstruck members 68 and 70. Adjustably secured intermediate the ends of the shaft 66 is an actuating device 72. Fastening means 74 serve to adjustably secure the actuating device 72 to the shaft. By this construction, the bail mechanism 64 may be adjusted to compensate for any "home" position the automatically controlled carrier may assume. As seen in FIGS. 2 and 3, the actuating device 72 includes a mounting bracket 76 and an outwardly extending arm 78 adapted to engage one free end of the latch member 58. A double acting actuating member 80, controlled by the circuitry of the machine, is operatively connected to the bail mechanism to effect rotation of the shaft 66. Rotation of the shaft 66 results in engagement of the actuating arm 78 with one end of the latch member 58 ultimately resulting in rotation of the revoluble shaft 50 carried by the release mechanism 48 whereby releasing the mutually engageable connector means. The return of the latch member 58 to the operative position shown in FIGS. 2 and 3 is effective through the reverse action of the actuating member 80 which is aided by a resilient member 82. In its preferred form, the resilient member comprises a torsion spring. One end 84 of torsion spring 82 is adapted to act against a stationary mounting pin 86 and the other end 88 of the spring operatively engages the latch member 58 to return same to its operative position.

Means for automatically ejecting the workholder from its connection with the automatically controlled carriage may also be provided. As shown in FIG. 3, an axially slidable lever means 90 functions as an ejection member and is formed with first and second spaced apart limb portions 92 and 94, respectively, with a U shaped central portion 96. The lever means first limb portion 92 is formed with an elongated slot 98 which accommodates two shoulder screws 100 and 102 which provide a fastening means by which the lever means 90 may be secured to the support plate 22. As understood, the sliding movement of lever 90 relative to the screws 100 and 102 is limited to the length of the slot 98. The second limb 94 of the lever means is adapted to abut the marginal edge 38 of the workholder and is effective to propel the workholder from the carriage assembly upon actuation of the ejection means. Captured between the arms 104 and 106 of the U shaped central portion of the lever means 90 is the other end 108 of latch member 58. The end 108 of latch lever 58 carries a pin 110 which is engagable with the arms 104 and 106 of the U shaped central portion of the lever. As may be best seen in FIG. 3, initial actuation of the latch member moves the pin 110 through a dwell. This dwell allows sufficient travel time for the camming members 56 to effect release of the coacting connector means whereby the workholder is free to be removed from its association with the automatically controlled carriage. Upon initial movement of the latch member 58, the lower end 108 of the latch member and the pin 110 carried thereby move from the solid line position shown in FIG. 3 to the dotted line position whereat the pin 110 engages the arm 106 of the U shaped lever portion. Continued movement of the latch member 58 causes axial movement of the ejection means to the extent allowed by the slot 98 whereby propelling the released workholder from its association with the automatically controlled carriage assembly. As understood, on its return, the latch member 58 carries with it the lever means 90 whereby returning the ejection member to the position shown in FIGS. 2 and 3.

In operation of the machine, the workholder is fixedly held to the carriage assembly by the coacting connector means. At the completion of the sewing operation, the bail mechanism 64 is automatically operated causing the latch member 58 to rotate the camming members 54 and 56 resulting in the uncoupling of the coacting connector means. Practically simultaneously therewith, the workholder ejection means automatically propels the released workholder from its association with the automatically controlled carrier thus allowing the sewing operator to remove the same from the sewing area. Following the release of the workholder from the carriage, the latch member is returned to the position shown in FIGS. 2 and 3 whereby lowering the positive postion and retaining 40 to accept another workholder.

Because the operation of the machine is automatic, during the sewing operation the operator is free to load a workpiece into a second workholder. Consequently, having removed the first workholder from the area the operator may immediately load the second prepared workholder. The workholder is easily affixed or locked to the carrier merely by sliding the workholder into a locking relationship with the automatically controlled carrier. The sliding action of the workholder causes the ball studs 36 to ramp open the spring loaded positive position and retaining means until the lug means 36 snap into the tapered socket whereby locking the workholder relative to the automatically controlled carriage or carrier.

Thus there has been provided a Quick Release Mechanism For The Workholder Of An Automatic Sewing Machine which satisfies the aims, objects and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus described the nature of the invention, what we claim herein is:

1. In a sewing machine having an automatically controlled carriage for moving a workholder in relation to the stitch forming instrumentalities of said machine during a sewing operation, means for removably securing the workholder to the automatically controlled carriage comprising:

a pair of cantilevered leaf spring means fixedly secured to said automatically controlled carriage;

positive position retaining means secured to the free end of said spring means for accepting and holding a generally spherical lug means carried by said workholder such that said workholder may be secured to said automatically controlled carriage; and means operative at the completion of the sewing operation for releasing said lug means from said position retaining means whereby said workholder may be detached from said automatically controlled carriage.

2. The invention according to claim 1 wherein said position retaining means includes a tapered socket and a camming surface extending away from said socket to permit said spring means to resiliently flex until said lug means snaps into said tapered socket whereby retaining said workholder in a fixed position.

3. The invention according to claim 1 wherein said positive position retaining means and said spherical lug means being configured so as to have a releasable wedging engagement therebetween, which wedging engagement is enhanced by the influence of said spring means.

4. The invention according to claim 2 wherein said positive position and retaining means further includes means for positively guiding said lug means into said socket means.

5. In a sewing machine having an automatically controlled carriage for moving a workholder in relation to the stitch forming instrumentalities of said machine, means for removably securing the workholder to the automatically controlled carriage comprising:

matable connector means arranged on said workholder and said automatically controlled carriage including a spring biased female receiving member and a male portion which cooperate to positively lock said workholder to said automatically controlled carriage; and means for releasing said connector means and for propelling said workholder away from said automatically controlled carriage.

6. The invention according to claim 5 wherein said releasing means includes means for relieving the spring action of said female member on said male member whereby releasing the workholder from its locking relationship with said automatically controlled carriage.

7. The invention according to claim 6 wherein said means for releasing and propelling includes a member which operatively engages and propels the workholder with the releasing action of said connector means.

8. In an automatic sewing machine having carrier means for moving a workpiece holder in relation to the stitching instrumentalities of the machine during a sewing cycle, a device for releasably securing the workpiece holder to said carrier means comprising:

matable connector means for affixing said workpiece holder to said carrier means including means for positively engaging and retaining a generally spherical insert means; and means capable of uncoupling said connector means and propelling said workpiece holder away from said carrier means.

9. The invention according to claim 8 wherein said positive engaging and retaining means includes a socketed member into which the spherical insert means is adapted to fit.

10. The invention according to claim 9 wherein said positive engaging and positioning means includes means for positively guiding the spherical insert means into said socket means.

11. In combination with an automatic sewing machine including a carrier means adapted to move a workholder in two coordinate directions during a sewing operation, an apparatus for securing the workholder to said carrier and characterized by the ability to permit the ready release and resecurement of a workholder comprising:

a pair of coacting connector means arranged on said workholder and carrier means and operative to fixedly couple said workholder and carrier means against movement relative to each other regardless of their direction of movement; and means operative to automatically uncouple said connector means at the completion of the sewing operation.

12. In combination with an automatic sewing machine including a carrier means adapted to move a workholder in two coordinate directions during a sewing operation, an apparatus for securing the workholder to said carrier and characterized by the ability to permit the ready release and resecurement of a workholder comprising:

a pair of coacting connector means arranged on said workholder and carrier means and operative to fixedly couple said workholder and carrier means together; and means operative to automatically uncouple said connector means at the completion of the sewing operation, said means operative includes a camming member for seperating the coacting connector means at the completion of the sewing operation whereby releasing the workholder.

13. In a sewing machine having an automatically controlled carriage for moving a workholder in relation to the stitch forming devices of the machine during a sewing operation, means for removably securing the workholder to the automatically controlled carriage comprising:

resiliently biased matable connector means arranged on said automatically controlled carriage means and said workholder, said matable connector means being so configured and positioned as to enable the workholder to be locked in place through a sliding action; and means operative at the completion of the sewing cycle for uncoupling said connector means and propelling said workholder away from said automatically controlled carriage.

14. In combination with an automatic sewing machine including a carriage adapted to move a workholder relative to a sewing machine needle during operation of the machine, a device securing the workholder to said carriage characterized by the ability to permit the ready release and resecurement of a workholder comprising:

mutually engageable parts arranged on said workholder carriage and operative to fixedly couple said workholder to said carriage;

means operative to uncouple said mutually engageable parts at the completion of the sewing operation; and workholder ejection means operable in relation with said means operative for removing the workholder from the area of the carriage.

15. In a sewing machine having an automatically controlled carriage for moving a workholder in two coordinate directions relative to the stitch forming devices of the machine during a sewing operation; and means for removably securing the workholder to the automatically controlled carriage comprising:

a pair of clearance free coacting connector means operative to fixedly couple said workholder and automatically controlled carriage against movement relative to each other regardless of their direction of movement;

means operative to positively release said workholder from said automatically controlled carriage at the completion of the sewing operation.

* * * * *